US007623015B2

(12) United States Patent
Bremicker et al.

(10) Patent No.: US 7,623,015 B2
(45) Date of Patent: Nov. 24, 2009

(54) ELECTRIC COIL OR POWER INVERTER

(75) Inventors: Sven Bremicker, Alheim-Baumbach (DE); Norbert Möller, Waldkappel (DE); Frank Lampe, Guxhagen (DE)

(73) Assignee: SMA Technologie AG, Niestetal (DE)

( * ) Notice: Subject to any disclaimer, the term of this patent is extended or adjusted under 35 U.S.C. 154(b) by 666 days.

(21) Appl. No.: 11/399,563

(22) Filed: Apr. 6, 2006

(65) Prior Publication Data

US 2006/0244554 A1 Nov. 2, 2006

(30) Foreign Application Priority Data

Apr. 28, 2005 (DE) ..... 10 2005 019 763

(51) Int. Cl.
*H01F 27/04* (2006.01)

(52) U.S. Cl. ..... 336/107

(58) Field of Classification Search ..... 336/65, 336/105, 107, 192; 439/246–250, 374, 578–580
See application file for complete search history.

(56) References Cited

U.S. PATENT DOCUMENTS 5,959,521 A * 9/1999 Kohmura et al. ..... 336/198
6,155,856 A * 12/2000 Sanada ..... 439/246
6,462,637 B1 * 10/2002 Laverick ..... 336/107
6,753,749 B1 6/2004 Chin

FOREIGN PATENT DOCUMENTS

| | | | |
|---|---|---|---|
| DE | 39 42 377 | A1 | 6/1990 |
| DE | 20108731 | U1 | 8/2001 |
| DE | 101 37 703 | A1 | 2/2003 |
| DE | 202004020191 | U1 | 3/2005 |
| EP | 1 447 882 | A | 8/2004 |
| JP | 11154546 | A | 6/1999 |
| WO | WO2005/004175 | A1 | 1/2005 |

* cited by examiner

*Primary Examiner*—Tuyen Nguyen
(74) *Attorney, Agent, or Firm*—Thomas R Vigil

(57) ABSTRACT

The subject matter of the invention is an electric coil such as the coil of a choke or of a transformer, said coil comprising at least one connecting member for connection to a printed circuit board, said connecting member (10) being configured to be a contacting dome, said contacting dome (10) comprising at least one cable socket (13), said printed circuit board (20) comprising a bridge (21) that is electrically connected to said printed circuit board (20), said bridge (21) being adapted for electrically conductive connection with the cable socket (13).

9 Claims, 4 Drawing Sheets

ELECTRIC COIL OR POWER INVERTER

CROSS-REFERENCE TO RELATED APPLICATIONS

This application claims Priority from German Application No. DE 10 2005 019 763.9-34 filed on 28Apr. 2005

FIELD OF THE INVENTION

The invention relates to electric coils, such as the coil of a choke or of a transformer, said coils comprising at least one connecting member for connection to a printed circuit board or to a power inverter having electric coils of the type mentioned herein above.

DESCRIPTION OF THE PRIOR ART

Heretobefore, what are termed terminal blocks or plug connectors are used for example for connecting coils, meaning transformers or chokes, to wiring boards. Such type terminal blocks or plug connectors have different mounts for the corresponding cables. This means that the cables are to be led from the coil, meaning for example from a bobbin of a transformer, to the wiring board where they are fastened to the corresponding assigned clamp of the terminal block for example.

With power inverters in particular, the coils, meaning for example the bobbin of a transformer, are disposed on the one side of a housing which is divided by a partition plate, whilst the wiring board is located on the other side of said partition plate. Printed circuit board and bobbin or coils are separated in this manner because the printed circuit board needs to be protected against dirt whilst the bobbin needs to be cooled by ambient air by corresponding fans, so that a higher degree of dirt is to be expected there. The printed circuit board or wiring board is to be protected against such type dirt in order for it to keep functioning, said printed circuit board being insofar, as already discussed, housed in a housing part that is separated from the bobbin.

In order now to connect the bobbin to the printed circuit board, prior art teaches to lead the cables one by one through the partition plate of the housing and to seal the feedthroughs. This involves considerable expense and is in particular prone to failure since there is always the risk of incorrectly connecting the cables to the clamps of the terminal blocks.

Screw connections however are also known from prior art to be used instead of these known terminal blocks, with the clamps then comprising screws for securing the cables.

BRIEF SUMMARY OF THE INVENTION

Thus, the problem underlying the invention was to ensure a simple and secure manner for the coil to contact the wiring board by designing the electric coil in a particular way. The invention aims more particularly at ensuring that the various cables are really connected to the locations provided therefore on the wiring board and that the sealing of the various cables in the region in which they are led through the partition plate is eliminated.

In accordance with the invention, the solution to this problem is to configure the connecting member to be a contacting dome, said contacting dome comprising at least one cable socket, the printed circuit board comprising a bridge electrically connected to the printed circuit board, said bridge being adapted for electrically conductive connection with the contact shoe. Since the bridges are disposed on the printed circuit board so as to correspond to the arrangement of the cable sockets in the contacting dome, the contacting dome and, as a result thereof, the various cable sockets can only be connected to the bridges in a determined position. This means that the arrangement of the bridges in connection with the arrangement of the cable shoes in the contacting dome dictates the connection of the contacting dome or of the various cable sockets to the corresponding bridges on the wiring board. Insofar, there is no or only little risk of incorrect connection.

More specifically, it is no longer necessary to seal the cables received by the dome in the region in which they are led through the partition plate. In this context, there is more specifically provided that the contacting dome comprises a circumferential collar that fits against the partition plate and thus seals the passage from the one side of the housing to the other side of said housing.

In accordance with another feature of the invention, there is provided that the cable socket comprises, on its side turned toward the printed circuit board, a threading for receiving a screw for electrical connection to the bridge of the printed circuit board. Such a screw connection allows for secure connection between the cable socket of the contacting dome and the corresponding bridges of the printed circuit board. Moreover, it will be obvious therefrom that, when the connection has been released, the screw is loose, which is visible to the naked eye—as already discussed.

In accordance with another feature of the invention, the bridge is approximately U-shaped in cross section, which means that the horizontally oriented portion of the bridge is oriented in a spaced-apart relationship with respect to the actual printed circuit board; in this horizontally oriented portion of the bridge, there is the opening for the screw. Since the bridge is configured to be flexible or resilient to a certain extent, the corresponding screw causes a slightly biasing connection to the cable socket to occur so that the screw will not readily untighten by itself.

In accordance with another feature of the invention, the legs of the U-shaped bridge are divided into various leg arms, with the spacing between the leg arms corresponding to the spacing of the circuit traces on the printed circuit board.

In accordance with an advantageous feature, there is provided that the cable socket is carried in the contacting dome so as to be movable in the longitudinal direction; this provision serves to prevent excessive load on the various components upon thermal expansion. The cable sockets are virtually floatingly mounted in the contacting dome, this allowing the contact shoes to accordingly give under thermal expansion. In this context, the contacting dome exhibits a feedthrough for receiving the contact shoe, said feedthrough comprising, in the region of the wall, superposed limit stops, said contact shoe comprising a collar that is carried between the limit stops so as to be longitudinally movable in the feedthrough.

Another subject matter of the invention is a power inverter with electric coils in accordance with one or more of the features discussed herein above. The power inverter has a housing, said housing comprising a partition plate, with the coils being disposed on the one side of the partition plate and the printed circuit board on the other side of said partition plate, said contacting dome projecting through said partition plate to be connected to the printed circuit board on the other side of said partition plate.

As already discussed herein above, power inverters comprise two separate housing halves or housing chambers, with the one chamber serving to accommodate the electronic components that are to be protected against dirt, whilst the other chamber of the housing only accommodates the components that are to be cooled, such as transformers for example. Since fresh outside air is drawn for cooling, a certain amount of dirt is always swept along therewith into this housing part, this however being harmless since such a transformer is in principle insensitive against dirt.

In accordance with another feature, there is provided that the coils are carried in a cup, said cup comprising a passage for the contacting dome to be led through the partition plate for connection with the printed circuit board.

Having the coils arranged in a corresponding cup or housing facilitates the assembly.

The invention will be described in greater detail herein after by way of example with reference to the drawings.

DETAILED DESCRIPTION OF THE INVENTION

Figure 1:
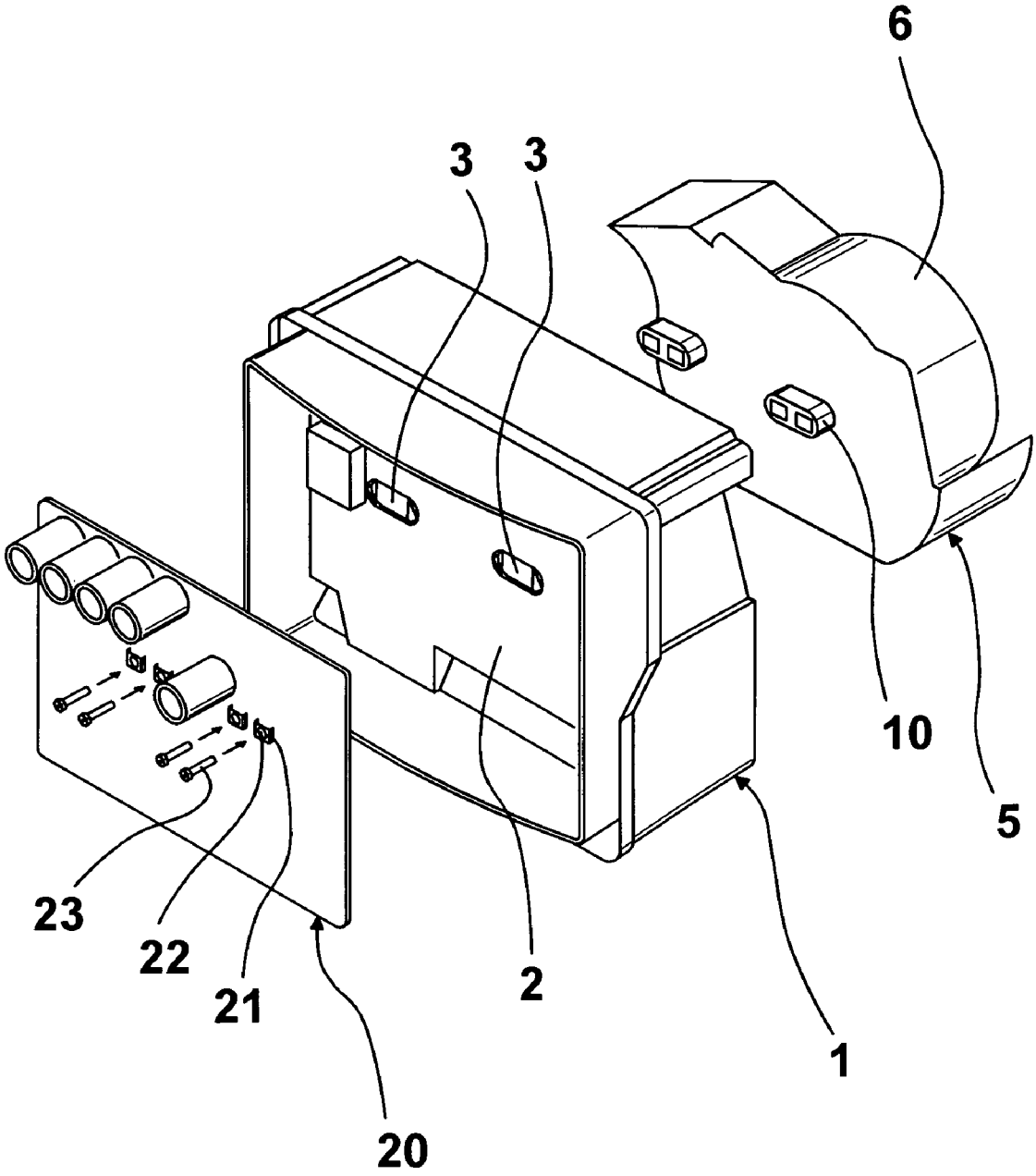
FIG. 1 shows the housing, the coil cup and the printed circuit board.

The housing indicated at 1 in FIG. 1 has a partition plate 2 with two elongate oval openings 3 for passage of the contacting domes 10 which project beyond the cup indicated at 5 and accommodating the coils 6. FIG. 1 moreover shows the wiring board indicated at 20, said wiring board exhibiting a plurality of U-shaped bridges 21 showing a hole 22 for passage of the screw 23.

As already discussed herein, the contacting domes 10 extend through the openings 3 in the partition plate 2 of the housing 1 and are connected, on the other side thereof, through the bridges 21 to the printed circuit board 20 by means of the screws 23.

Figure 2:
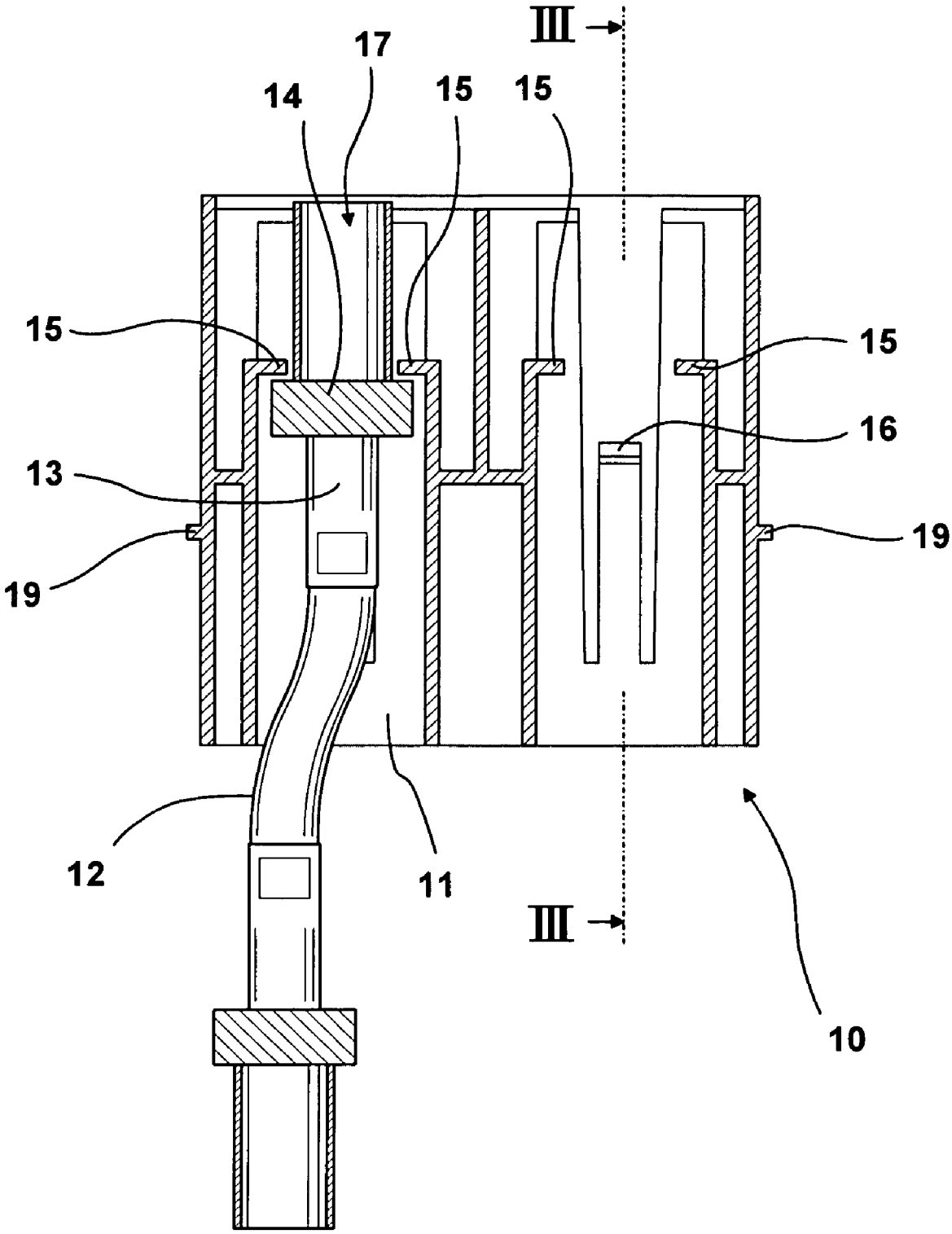
FIG. 2 shows a sectional view of the contacting dome with the cable socket.
Figure 3:
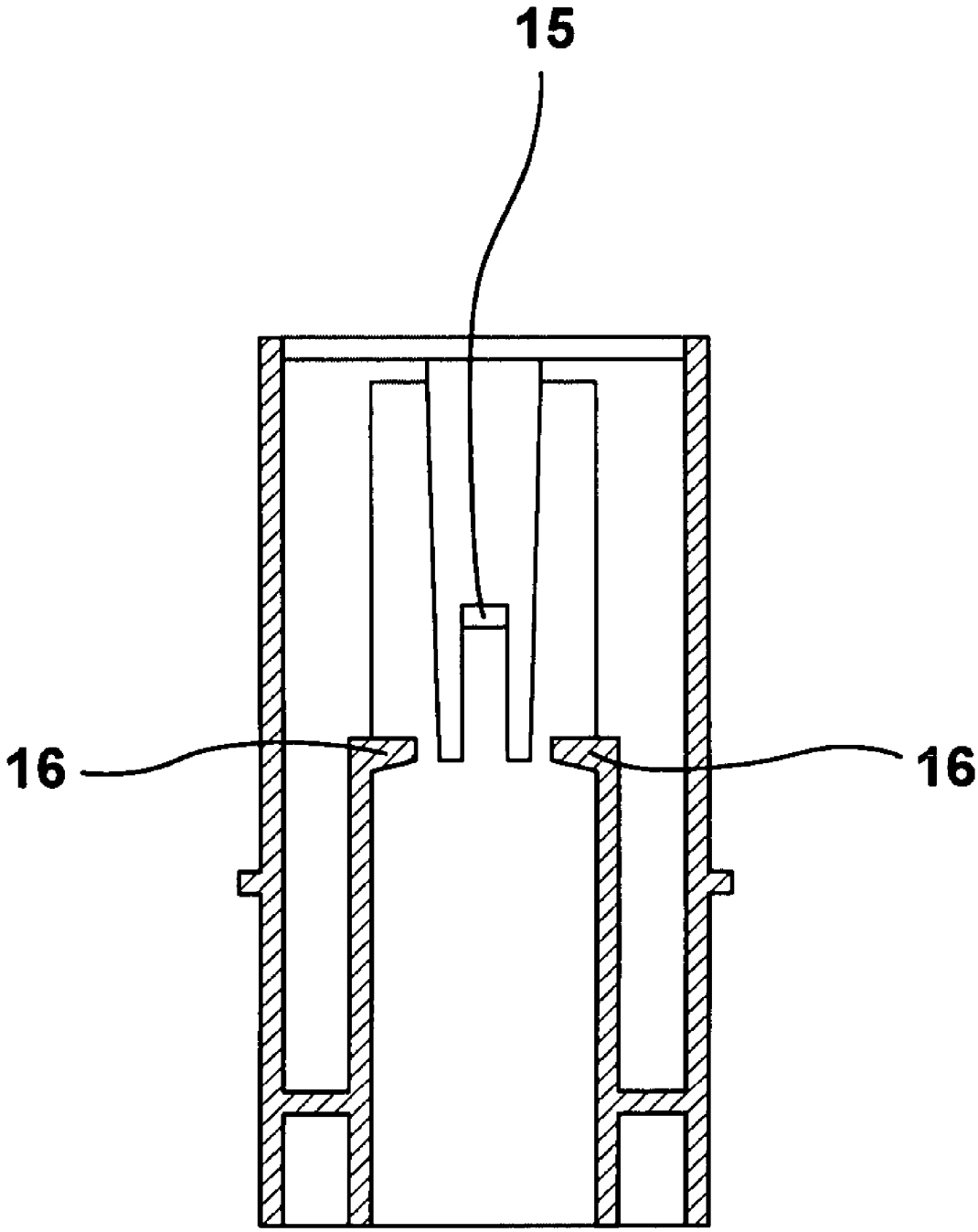
FIG. 3 shows a sectional view taken along the line III-III of FIG. 2.

The configuration of the contacting domes 10 can be seen from the FIGS. 2 and 3. The contacting dome 10 has the feedthrough for the cable 12 with the cable socket 13, said feedthrough being indicated at 11. The cable socket clampingly receives the cable 12 and has a square collar 14. This collar rests in the region of the feedthrough 11. Moreover, in the region of the feedthrough 11, there is provided a limit stop on either side of the square feedthrough, with two limit stops being respectively disposed on the same height on opposite sides. That is to say, the various limit stops 15, 16, which are configured to be an elastic tongue, are spaced a distance apart that is greater than the height of the collar 14 so that the collar 14 is slidable in the longitudinal direction within this space, which is formed by the limit stops 15 and 16. Such a longitudinal sliding capacity serves to compensate for length in case separate parts of the overall construction, the coils in particular, are heated. Meaning, the cable socket is floatingly mounted.

The cable socket 13 moreover exhibits a threaded bush 17 for accommodating the screw 23.

Figure 4:
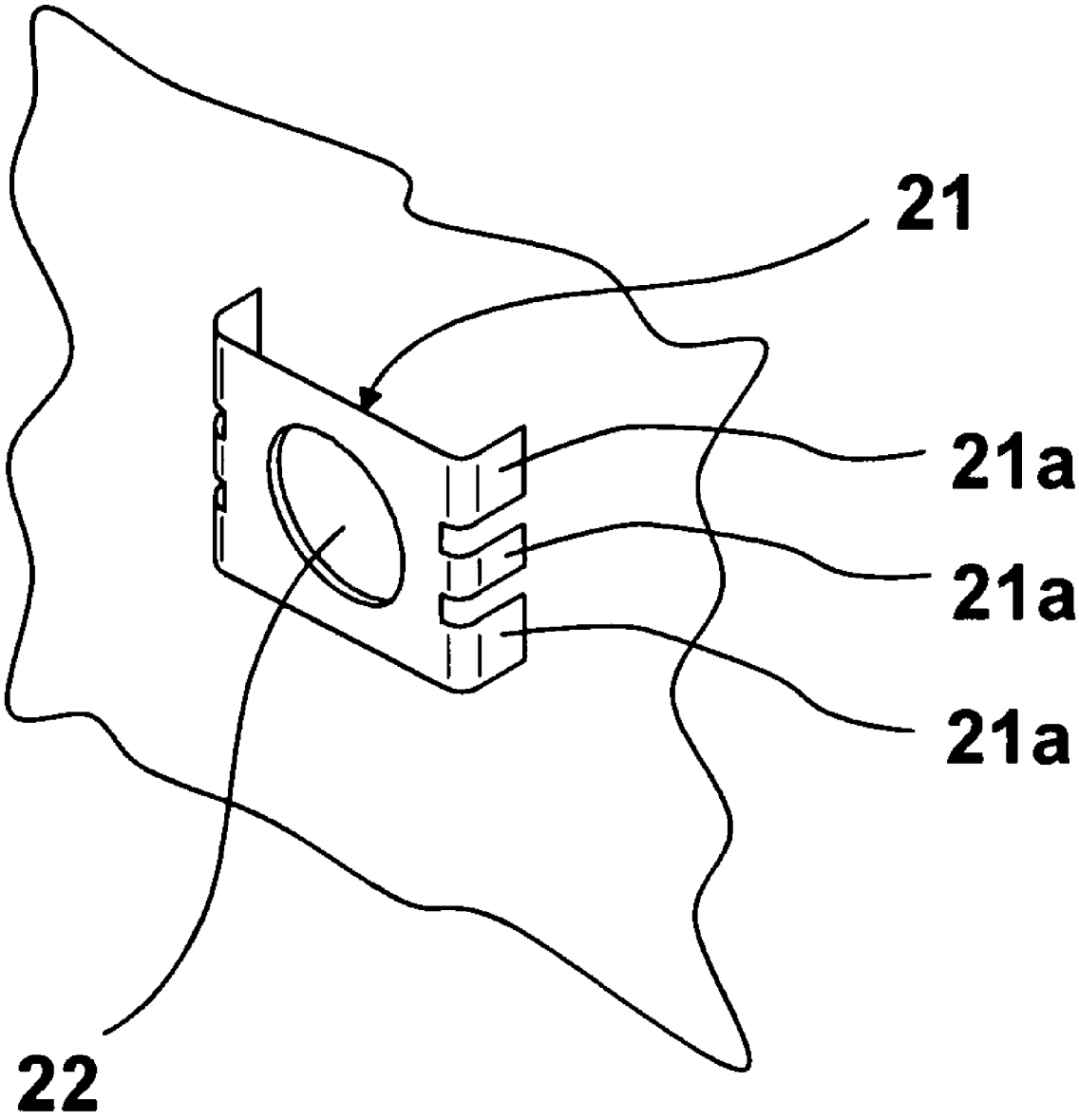
FIG. 4 shows the bridge on an enlarged scale.

FIG. 4 shows in greater detail the configuration of the bridge 21 insofar as the bridge 21 comprises a plurality of leg arms 21*a* with every single leg arm being connected such as by welding to the corresponding circuit trace on the wiring board.

FIG. 2 moreover shows the circumferential rim 19 at which the contacting dome fits against the partition plate and through which the passage from the one housing part, which accommodates the coils, to the other housing part, which accommodates the printed circuit board, is finally sealed.

We claim:

1. An electric coil such as the coil of a choke or of a transformer, said coil comprising at least one connecting member for connection to a printed circuit board, whereby said connecting member (10) is configured to be a contacting dome, said contacting dome (10) comprising at least one cable socket (13), said printed circuit board (20) comprising a bridge (21) that is electrically connected to said printed circuit board (20), said bridge (21) being adapted for electrically conductive connection with the cable socket (13).

2. The electric coil as set forth in claim 1, wherein the contacting dome (10) comprises a circumferential rim (19).

3. The electric coil as set forth in claim 1, wherein the cable socket (13) comprises, on its side turned toward the printed circuit board, a threading (7) for receiving a screw (23) for electrical connection to the bridge (21) of the printed circuit board (20).

4. The electric coil as set forth in claim 3, wherein the bridge (21) approximately U-shaped in cross section.

5. The electric coil as set forth in claim 4, wherein the leg of the U-shaped bridge (21) is divided Frito various leg arms (21*a*), with the spacing between the leg arms (21*a*) corresponding to the spacing of the circuit traces on the printed circuit board (20).

6. The electric coil as set forth in claim 1, wherein the cable socket (13) is carried in the contacting dome (10) so as to be movable in the longitudinal direction.

7. The electric coil as set forth in claim 1, wherein the contacting dome (10) comprises a feedthrough (11) for receiving the cable socket (13), said feedthrough comprising, in the region of the wall, superposed limit stops (15, 16), said cable socket (13) comprising a collar (14), said collar (14) being carried between said limit stops so as to be longitudinally movable in said feedthrough (11).

8. An electric coil as set forth in claim 1 for use in a power inverter, wherein said power inverter comprising a housing (1), said housing (1) comprising a partition plate (2), with the coil (6) being disposed on the one side of said partition plate (2) and the printed circuit board (20) on the other side of said partition plate (2), the contacting dome (10) projecting through said partition plate (2) to be connected to said printed circuit board (20) on the other side of said partition plate (2).

9. The power inverter with electric coil as set forth in claim 8, wherein the coil (6) is carried in a cup (5).

* * * * *

UNITED STATES PATENT AND TRADEMARK OFFICE

CERTIFICATE OF CORRECTION

PATENT NO. : 7,623,015 B2
APPLICATION NO. : 11/399563
DATED : November 24, 2009
INVENTOR(S) : Sven Bremicker, Norbert Moller and Frank Lampe It is certified that error appears in the above-identified patent and that said Letters Patent is hereby corrected as shown below:

Claim 5, Patent Column 4, line 32, "frito" should be --into--.

Signed and Sealed this

Seventh Day of December, 2010

David J. Kappos

David J. Kappos
*Director of the United States Patent and Trademark Office*